United States Patent [19]

Bienvenu et al.

[11] Patent Number: 4,652,299

[45] Date of Patent: Mar. 24, 1987

[54] PROCESS FOR TREATING METALS AND ALLOYS FOR THE PURPOSE OF REFINING THEM

[75] Inventors: Gerard Bienvenu, Sevraz; Michel Jehan, Route de Douvaine, both of France

[73] Assignee: Extramet Industrie S.A., Annemasse, France

[21] Appl. No.: 799,346

[22] Filed: Nov. 5, 1985

[30] Foreign Application Priority Data

Nov. 5, 1984 [FR] France ..... 84 16971

[51] Int. Cl.[4] ..... C21C 7/02

[52] U.S. Cl. ..... 75/58; 75/53; 420/590; 420/20

[58] Field of Search ..... 75/53, 58, 129, 130 R; 420/590

[56] References Cited

U.S. PATENT DOCUMENTS

| | | | |
|---|---|---|---|
| 2,971,833 | 2/1961 | Artru et al. | 75/10 R |
| 3,767,380 | 10/1973 | Csepanyi | 75/58 |
| 4,014,686 | 3/1977 | Bassett | 75/58 |
| 4,137,072 | 1/1979 | Kawakomi | 75/58 |
| 4,286,984 | 9/1981 | Luycky | 75/58 |
| 4,462,823 | 7/1984 | Fontaine | 75/58 |

OTHER PUBLICATIONS

Kenneth A. Bowman, Magnesium by the Magnetherm Process-Process Contamination and Fused Salt Refining, Alcoa; Light Metals, 1986, vol. 2.

*Primary Examiner*—Peter D. Rosenberg
*Attorney, Agent, or Firm*—Wegner & Bretschneider

[57] ABSTRACT

The refining additive is an alloy in the form of granules of a metal selected from the group of alkaline earth metals and zinc with a small quantity of a metallic element capable of giving the alloy a substantially lower melting point. The alloy can be a eutectic alloy.

This alloy, which is in the form of granules, allows the treatment of steels, cast iron and non-ferrous metals at lower temperatures and with a substantial reduction in bubble formation.

The alloy may be introduced in the form of a core wire.

46 Claims, 4 Drawing Figures

PROCESS FOR TREATING METALS AND ALLOYS FOR THE PURPOSE OF REFINING THEM

The present invention relates to a process for treating metals and alloys, more particularly but not exclusively ferrous metals and alloys, notably those having a high melting point, for example greater than 1000° C.

For carrying out this process, a refining additive is incorporated in the molten metal.

The production and refining of liquid metal compositions and particularly production of certain steels necessitates the introduction of additives in powder form.

In the range of steels designed for continuous casting, these additives play an important role in reducing the oxygen content. By controlling the total oxygen content in this way, the steel maker can completely control the castability of the metal through calibrated casting orifices. The additive furthermore allows the level of the elements such as sulphur and phosphorus, to be adjusted under certain conditions of use. A favourable effect on the number and the morphology of the inclusions is obtained. This is notably the case with the aluminium inclusions in processes in which steel has been aluminium-killed.

For several years, calcium has begun to be used as a refining additive. Metallic calcium has numerous advantages and its efficiency is all the more important since the addition is measured and controlled as a function of time. The influence of the addition of calcium to the molten steel on the oxygen, sulphur, phosphorus contents in a steel bath is known in detail.

The addition of calcium in the interior of the molten composition can be carried out by means of processes for introducing additives, for example by the "core wire technique" which will be described in more detail below.

Furthermore, with respect to the granulation of calcium and the preparation of granulated calcium, reference may advantageously be made to the description of the invention FR 2 471 827.

The disadvantage of refining with pure calcium is that this metal is very reactive and has a high vapour pressure at the temperatures which are conventional for treating the liquid composition. The introduction of calcium entails the formation of bubbles such that it is often necessary to use it together with diluents, for example compounds of oxides of calcium aluminate, fluorspar or lime.

According to the invention, an alloy of a metal selected from the group comprising the alkaline earth metals and zinc is used as refining additive together with a small quantity of a metallic element which is capable of giving the alloy a melting point which is substantially lower than that of the alkaline earth metal or pure zinc. Moreover, the alloy is in the form of granules. The refining alloy can be binary, ternary or multicomponent.

In other words, the refining additive is an alloy in the form of granules, each granule having a substantially spherical form. The alloy is made up of one or more metals selected from beryllium, magnesium, calcium, strontium, barium and zinc and one or more metals, the composition being situated in the zone of the phase diagram starting from the alkaline earth metal or pure zinc and going towards the first eutectic point. This zone will be referred to as the "first eutectic point" since it corresponds to a lowering of the melting point towards a binary or multicomponent eutectic. The refining alloy will thus be an alloy situated in the eutectic zone, including the eutectic itself.

Metals capable of alloying in small quantities with alkaline earth metals or zinc to form an alloy in the eutectic zone or a eutectic, are notably aluminium, copper, nickel, bismuth, lead, tin, lanthanum and silicon, as well as zinc and magnesium when alloyed to at least one other metal. Alloys of silver and gold are also suitable, but are of little interest industrially in view of their cost.

As binary alloys, it is advantageous to mention the alloys of calcium or magnesium with aluminium, copper or nickel. As ternary alloys, the alloys calcium, nickel, aluminium and calcium, magnesium, aluminium may be mentioned, for example.

It was discovered in a completely unexpected way that the presence of one of the metals in the above category led to a very substantial reduction in bubble formation on introduction of the treatment additive. This can be explained by a substantial reduction in the vapour pressure of the additive in the form of the alloy as compared to a pure additive, and by complete control of the flow of the additive during its introduction into the metal to be treated, as a result of its substantially spherical form.

Thus, in the case of a calcium alloy introduced into liquid steel in the form of granules, it is possible to increase the continuous introduction of this additive up to quantities of 150 ppm per minute, values which are impossible to attain with pure calcium in granules, and even more so with ungranulated pure calcium.

To attempt to explain this phenomenon from the point of view of thermodynamics the starting point is the equation which expresses as a first approximation the activity coefficient of a highly diluted element in a solvent, as the function $\gamma_{AE}$ (where AE represents alkaline earth metal or zinc).

It is to be remembered that the activity coefficient of an element such as an alkaline earth metal, highly diluted in a solvent, is expressed to a first approximation by a relationship of the type:

$$\text{Log } \gamma_{AE} = \text{Log } \gamma_{AE}^{\infty} + \epsilon_{AE}^{AE} x_{AE} + \epsilon_{AE}^{i} x_i$$

wherein $\gamma_{AE}^{\infty}$ represents the activity coefficient of AE in the solvent, for example calcium in pure iron, at an infinite dilution.

$x_{AE}$ represents the atomic fraction of the selected element "i", alloyed to the alkaline earth metal or to zinc.

The function $\epsilon_{AE}^{i}$ which is substantially negative, results in a substantial decrease of the activity in the solvent, for example calcium in steel and consequently of its vapour pressure.

The vapour pressure of the selected alkaline earth metal (or zinc) taken separately, is advantageously as low as possible; the metals selected for the alloy form compounds with which the eutectic alloy is in equilibrium at the eutectic temperature, which are defined by a very negative free enthalpy of formation.

It is to be clearly stated, moreover, that this is a question of an alloy, each granule of which is itself an alloy, and not of a statistical mixture of the two metals.

Such a statistical mixture would neither lead to a decrease in the melting point nor to the unexpected effects mentioned above. Evidence of this is given by the calcium, manganese mixtures which do not form true alloys and thus are of no interest for carrying out the process according to the invention.

The addition of the alloy in granules is carried out by conventional deep introduction techniques in the molten metallic bath, the granules being substantially spherical, calibrated, constant and homogeneous. Their microstructure is closed and their diameter is from 0.1 to 2.5 mm, preferably from 0.2 to 2.5 mm. This finely-divided form is free from dust having a fine granulometry; this gives the product complete security of use; thus all danger of explosion or of self-ignition due to the pyrophoric nature of the reactive alloys is removed.

The invention also has great advantages with respect to the production of these granulated alloys. Indeed, in the case of granulation in the liquid phase, it is possible to work at a lower temperature and to achieve substantial savings in energy.

According to another aspect of the invention, the alloy to be added is introduced by means of a core wire. The term core wire is used here to describe a product comprising an elongated, tubular metallic casing in the interior of which is disposed a material in a divided form. The core wire allows this material to be introduced into a molten metallic bath without loss of and without notable modification of this material.

Such a method for treating metallic baths is well known. Thus, patent EP 34 994 describes a composite product with a tubular casing and a core of a compressed pulverulent material which is particularly used for treating liquid steel (column 6, line 36 to column 7, line 6). This core wire comprises a thin casing consisting of steel and a core of pulverulent material containing calcium.

As already explained above, calcium allows the content of soluble oxygen in the steel to be reduced and at the same time favours its desulphurization. It also allows the nature and the morphology of the inclusions to be modified, such that those of aluminium which are converted into liquid lime aluminates. Obstruction of pouring spouts is thus prevented, a phenomenon which particularly hinders continuous casting, and also the formation during hot welding of extended lines of inclusions which reduce the ductility across the products obtained. Finally, these modified inclusions are less abrasive with respect to the cutting tools for high speed machining.

As a result of using the core wire, calcium can be introduced without difficulty at the base of a pocket filled with liquid steel, in which it can also react in a particularly efficient manner. But violent bubble formation in the steel caused by the sudden volatilization of the calcium is not avoided. The vapour pressure is about 1.8 atm at 1600° C. This bubble formation, if it is too intense, can upset the penetration conditions of the core wire in the steel bath. At the same time, peaks of liquid steel are produced which penetrate the layer of slag and become oxidized on contact with air before falling back. An increase in the contents of O2, N2 and even H2 in the steel obtained is thus noted.

Experience has shown that if a material containing non-alloyed calcium is used for the core of the core wire, the speed of introducing the calcium in the liquid steel must be limited to from about 30 to 40 g per tonne of liquid steel and per minute. As in practice, from about 125 to 600 g of Ca per tonne of liquid steel are introduced to the total, it is to be seen that the treatment has a duration of from 4 to 15 minutes.

The thickness of the casing of the core wire and its interior section should be adjusted as a function of this speed of introduction in such a manner that the casing of the core wire does not dissolve prematurely before having reached the base of the pocket of liquid steel.

The use of a core wire containing alloy granules allows the above-mentioned problems to be neatly overcome, the problems being of the same nature, in the case of both calcium and other alkaline earth metals.

According to this aspect of the invention, the alloy preferably contains, in terms of mass, at least 80% of Ca and up to 15% of Ni or of Al. The content of Ni or Al of this alloy is advantageously from 3% to 12%, for example 5%.

As the need arises, this alloy can be mixed with other alloys which are likely to introduce calcium without excessive agitation of the bath, for example a silico-calcium in an amount of 30% of the mass of Ca.

The alloy preferably represents at least 30% by weight of the total mass of the core of the core wire. A core wire containing at least 50% by weight of the alloy is particularly useful.

the speed of introduction of the core wire containing the Ca alloy (for example) in liquid steel is also preferably adjusted in such a manner that the quantity of Ca introduced per minute is from about 80 to 120 g of Ca per tonne of liquid steel, the total quantity of Ca introduced being from 125 to 600 g per tonne of liquid steel.

The introduction of the core wire can be carried out most of the time in a conventional manner in a casting pocket, but other methods of introduction can be conceived, for example introduction in the distributor (also called tundish) in the case of continuous casting.

The range of steels which are improved by being refined according to the invention by means of the granules of alloys of alkaline earth metals and the above-mentioned metals are, in particular, those steels with a very low content of residual elements such as carbon and silicon, for example the range of steels used for deep drawing.

The silicon content of the liquid steel should thus be limited to below 300 ppm before introducing the core wire and it may be necessary to raise the percentage of alloy in the wire up to 100%.

The additive in the form of granules is also very suitable for refining other ranges of steels such as stainless steels.

Other materials apart from steel can also be refined with these granules, for example cast iron, ferronickel, ferrochrome and ferromanganese, as well as nickel and Blister copper.

Finally, metals of non-ferrous metal and aluminium can be refined, for example by granules of alloys of strontium and aluminium, optionally containing lithium.

The invention also relates to a core wire notably allowing the treatment of metals, for example liquid steel, the core of which contains an alloy, as described above, for example, based on calcium containing at least 75% in mass of Ca and at least 3% in mass of Ni and/or at least 3% in mass of Al. The remainder of the composition can comprise different impurities and complementary additions. For example, the possible complementary addition can consist of Si at a rate of from 5 to 15% in mass.

The invention is illustrated by the following non-limiting examples, supplemented by the drawings. Examples 10 and 11 with the numerous experiments, particularly relate to the core wire.

EXAMPLES

| Examples | Alloy | Composition by weight | Melting point* |
|---|---|---|---|
| 1 | Ca/Ni | 80/20 | 605 |
| 2 | Ca/Ni | 95/5 | 800 |
| 3 | Ca/Ni | 90/10 | 720 |
| 4 | Ca/Al | 85/15 | 740 |
| 5 | Ca/Al | 65/35 | 540 |
| 6 | Ca/Mg/Al | 82/12/5 | 730 |
| 7 | Ca/Cu | 72/28 | 700 |
| 8 | Ca/La | 90/10 | 720 |
| 9 | Mg/Ni | 80/20 | 550 |

*Melting point of the eutectic or initial melting point.

Examples 1 to 3

A calcium nickel alloy can contain up to 16 atomic % of nickel or about 20% by weight.

As can be seen in the attached drawing, FIG. 1, representing the phase diagram Ca/Ni, calcium melts at about 850° C. and forms with nickel, a eutectic alloy melting at about 605° C., corresponding precisely to the 16 atomic % mentioned above.

The eutectic zone is thus the zone situated to the left of the diagram and extending up to 16 atomic % of nickel alloyed to calcium, including the eutectic itself.

Compositions of from 5% (melting around 800° C.) to 16 atomic % of nickel are preferably selected.

As indicated further above, the Ca/Ni alloy can be added to the steel in an amount of 150 ppm per minute, an addition rate which it is not possible to maintain with pure calcium.

During injection, no agitation of the material is noted on the surface, and excellent cleanliness of the metal and perfect castability thereof during continuous casting is noted.

Moreover, another unexpected result is that it has been noted that the presence of nickel substantially facilitates the solubility of the calcium in certain steels.

This phenomenon can be explained thermodynamically since the Ca/Ni intereaction is substantially negative, that is the activity coefficient of calcium in iron with infinite dilution is substantially lowered by the presence of a small amount of nickel.

It should finally be pointed out that the presence in the steel of the element added to calcium, that is nickel, at the above-mentioned rates is in no way detrimental to the quality of the final steel. The nickel dissolves totally and only represents an amount comparable to a neglibible quantity.

Examples 4 and 5

These examples show the physical and chemical characteristics of the alloy in the form of granules, and are carried out on a steel with a very low carbon content, aluminium-killed, for the production of sheet metal for deep drawing.

The steel to be refined should have the following composition

| C max | Si max | Mn max | Al max | S max | P max |
|---|---|---|---|---|---|
| 0.040% | 0.018% | 0.40% | 0.07% | 0.005% | 0.015% |

The characteristics of the alloy to be added are as follows:

granules of calcium containing 5% of aluminium (Example 4)

quantity injected = 420 ppm quantity of steel treated = 152 tonnes

The steel obtained is shown after analysis to have the following composition:

| C | Si | Mn | Al | S | P | Ca |
|---|---|---|---|---|---|---|
| 0.04% | 0.007% | 0.38% | 0.035% | 0.004% | 0.012% | 0.0038% |

Here too, few fumes are noted, no ignition of the material on the surface, an excellent quantity of cleanliness of the metal and perfect castability during continuous casting.

Examples 6 to 9

The ternary alloy Ca/Mg/Al of Example 6 is notably used for treating lead owing to its low melting point and increased speed of dissolution. It is to be noted that this alloy is of great interest for removing bismuth from lead.

The Ca/Cu alloy in Example 7 can be used for treating bronze owing to its low melting point and the reduced bubble formation which it entails.

The Ca/La alloy in Example 8 can be used for treating steel and cast iron, where, apart from the reduced bubble formation which it entails, it allows very good desulphurization and a very fine control of the graphitization.

The Mg/Ni alloy in Example 9 can be used for treating stainless steels, its melting point being particularly low. It entails reduced bubble formation in the same way as the Ca/Ni alloys in Examples 1 to 3.

FIG. 1 is a diagram showing the relation between temperature and the atomic percentage Ca/Ni in the alloy.

Example 10

Figure 2:
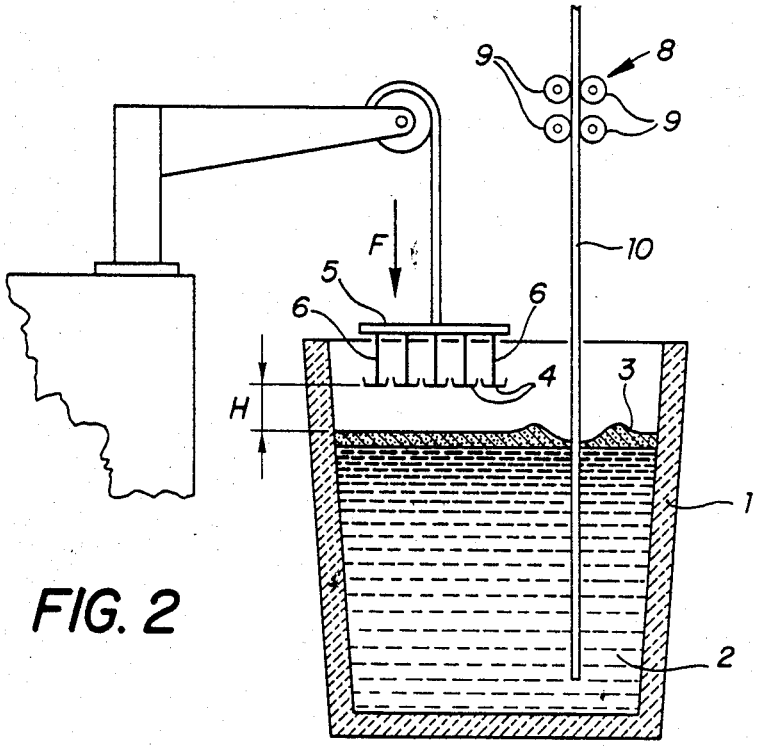
FIG. 2 is a diagram of a device allowing the intensity of bubble formation of the liquid steel caused by the introduction of a core wire containing calcium to be evaluated.

FIG. 2 shows a pocket (1) containing 83 t of liquid steel (2). This non-alloyed steel which has undergone previous deoxidation contains C=0.12% and Mn=0.6%. It is covered by a layer of slag (3). At a distance (H) of 300 mm from the surface of the slag, 16 steel cupels are positioned, such as (4), about 50 mm in diameter suspended below a steel disc (5) with a diameter of 1.2 m, itself suspended above the pocket.

Figure 3:
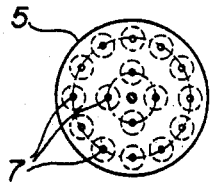
FIG. 3 is a detail of FIG. 2 seen along the arrow (F).

In FIG. 3 can be seen the ends such as (7) of the fixing rods (6) of the cupels which cross the disc to which they are attached according to a distribution which is as regular as possible. To the right of FIG. 2, a device (8) shown in a diagrammatic manner, comprises rolls (9) which cause a core wire (10) to penetrate in the liquid steel from top to bottom in a substantially vertical manner.

Preliminary experiments have shown that the intensity of bubble formation of the liquid metal, caused by introducing a core wire, should not be such that half the cupels (4) receive peaks of metal and/or of slag. These preliminary experiments have also shown that in the case of a core wire of which the core is non-alloyed divided calcium, this intensity of bubble formation is reached with a speed of introduction corresponding to 40 g of Ca per tonne of liquid steel and per minute.

Figure 4:
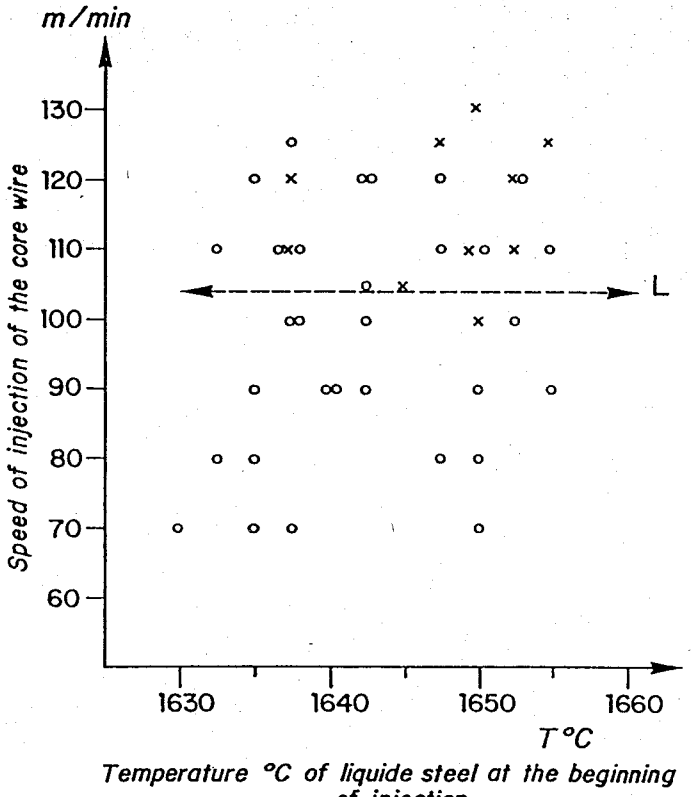
FIG. 4 is a diagram showing the relationship between the speed of introduction of the core wire and the intensity of bubble formation of the liquid steel.

Systematic experiments are thus carried out on the castings of an arc furnace producing a non-alloyed steel of the type A42, containing C=0.12% and Mn=0.6%. FIG. 4 shows the results obtained in diagrammatic form. 41 steel castings are tested. Each of these castings with a weight of 83 t is positioned in the pocket (1) in FIG. 2 then treated with the core wire (10). This core wire has a soft steel casing with a thickness of 0.4 mm and a rectangular section of 16×7.5 mm. The core of this core wire is a divided material consisting of a CaNi alloy containing 87% in mass of Ca and 11% in mass of Ni. The weight of alloy per meter contained in the core wire is 110 g or 95.7 g of Ca. In FIG. 4, the speeds of introduction of the core wire in m/min can be seen on the Y-axis. On the X-axis, the temperatures of the liquid steel are given. The result of each experiment is shown by a cross (x) or a circle (o). A cross (x) corresponds to a too intense bubble formation in the liquid steel in which peaks of steel and slag have reached more than 8 cupels (4). A circle (o) corresponds to an acceptable bubble formation in which no more than 8 cupels have been reached.

It can be seen that the dotted line (L) in FIG. 4 separates a lower zone, for which, out of 19 experiments, only one entails a too intense bubble formation, from an upper zone for which out of 22 experiments, 9 entail a too intense bubble formation. This line (L) corresponds to a speed of introduction of the core wire of 105 m/min, which corresponds in the case of a mass of liquid steel of 83 t to 120 g of Ca/t/min.

By way of comparison, 52 castings of the same steel are treated in the same manner by means of a core wire, having the same dimensional characteristics, the core of which consists of a SiCa alloy containing in mass 60% of Si and 30% of Ca.

In drawing up a diagram similar to that of FIG. 4, it is noted that a line of separation can be traced between a lower zone for which the great majority of the results do not give rise to a too intense bubble formation, and an upper zone for which this bubble formation becomes too intense. This separating line corresponds to a speed of introduction of the core wire of 120 m/min. This wire contains 180 g of SiCa alloy per meter and the maximum speed of introduction of Ca is thus 78 g/t/min in this case.

Moreover, analyses carried out after introducing Ca by one or other of these two methods show that the proportion of Ca fixed by the steel liquid in relation to the quantity of Ca introduced is the same, or on average 15%. On the other hand, when using the SiCa alloy, 100% of the Si introduced is in practice fixed in the liquid steel, which represents an addition of from 250 to 1200 ppm of Si according to the quantity of Ca introduced, in a range of from 125 to 600 g of Ca per tonne of steel. Such an addition of Si is incompatible with the production of a steel for deep drawing for which the content of Si should be less than 300 ppm and even, in a certain case, less than 200 ppm.

Example 11

The invention can also be used by way of another Example by mixing a Ca-Si alloy with the Ca-Ni alloy which forms the essential constituent of the core of the core wire.

In this manner, a particularly efficient treatment is produced by a core wire comprising, respectively by weight, as material constituting the core, 50% of the Ca-Ni alloy with 90% of Ca and 8% of Ni and 50% by weight of Ca-Si alloy with 30% of Ca and 60% of Si.

Indeed, in relation to a Ca-Si core wire with 30% of Ca and 60% of Si, it is sufficient, in order to provide the same quantity of wire powder according to the invention, which is two times less than the pure silico-calcium powder with, consequently a quantity of silicon introduced which is four times smaller.

The process according to the invention can form the object of numerous modifications which do not depart from the scope of the invention. The invention also relates to the core wire. The casing of this wire can particularly be produced either from steel, or from another metal which is compatible with the bath to be treated. Similarly, the material which forms the core of this core wire, of which the alloy based on calcium according to the invention forms the essential constituent, can comprise other elements or compounds which contribute to the treatment of the liquid metal.

We claim:

1. A process for treating a metal or alloy which comprises adding thereto, when said metal or alloy is in a molten state, a refining additive, said refining additive consisting essentially of an alloy of a metal selected from the group consisting of alkaline earth metals and zinc, together with a quantity of a metallic element which is sufficient to give the alloy a melting point which is substantially lower than that of said alkaline earth metal or pure zinc, the refining additive being used in the form of granules.

2. A process according to claim 1, in which said metallic element is selected from the group consisting of aluminium, copper, nickel, bismuth, lead, tin, lanthanum, silicon, zinc alloyed with at least one other metal, and magnesium alloyed with at least one other metal.

3. A process according to claim 1, in which said alloy to be added is a eutectic alloy.

4. A process according to claim 1, in which said alloy to be added is an alloy situated in the first eutectic zone.

5. A process according to claim 1, in which said alloy to be added is a calcium and nickel alloy containing up to 16 atomic % of nickel.

6. A process according to claim 1, in which said alloy to be added is a magnesium and nickel alloy containing up to 11.3 atomic % of nickel.

7. A process according to claim 5, in which said alloy is added at a rate of up to 150 ppm per minute.

8. A process according to claim 7, in which said alloy to be added has a grain size of from 0.1 to 2.5 mm.

9. A process according to claim 1, in which said alloy is added in the form of core wire, said alloy forming a core and being surrounded by an elongated tubular casing.

10. A process according to claim 9, in which said alloy contains at least 80% of Ca and up to 15% of Ni or 80% of Ca and up to 15% of Al, in % by weight.

11. A process according to claim 10, in which the speed of introduction of said core wire in liquid steel is adjusted in such a manner that the quantity of calcium introduced is from 80 g to 120 g per tonne of liquid steel per minute.

12. A process according to claim 9, in which treatment is carried out in a pocket and/or in a distributor.

13. A process according to claim 1 for refining a material selected from the group consisting of stainless steel, highly alloyed steel, cost iron, or steels with a low content of carbon, silicon, or residual elements.

14. A process according to claim 13 for refining a liquid steel of which the content of Si before introduction of the alloy is at most equal to 300 ppm so as to obtain a steel which is suitable for deep drawing with a low final Si content.

Figure 1:
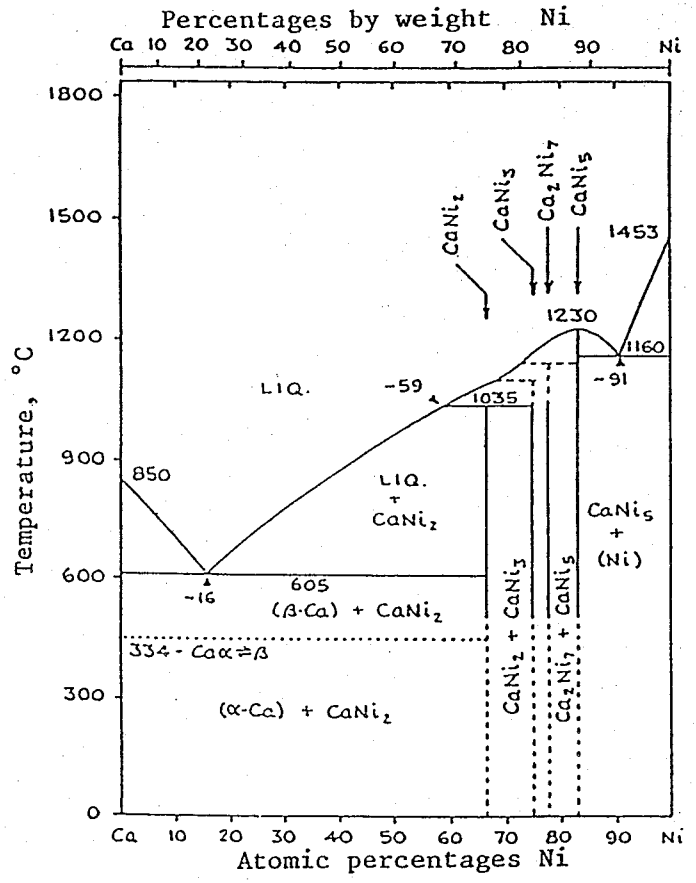

15. A process for treating a metal or alloy which comprises adding thereto, when said metal or alloy is in a molten state, a refining additive consisting essentially of an alloy of a metal selected from the group consisting of alkaline earth metals and zinc, together with a quantity of a metallic element which is sufficient to situate the alloy in the first eutectic zone in drawing FIG. 1, the refining additive being used in the form of granules.

16. A process according to claim 15, in which said metallic element is selected from the group consisting of aluminum, copper, nickel, bismuth, lead, tin, lanthanum and silicon, zinc alloyed with at least one other metal, and magnesium alloyed with at least one other metal.

17. A process according to claim 15, in which said refining additive to be added is a calcium and nickel alloy containing up to 16 atomic % of nickel.

18. A process according to claim 15, in which said refining additive to be added is a magnesium and nickel alloy containing up to 11.3 atomic % of nickel.

19. A process according to claim 17, in which said refining additive is added at a rate of up to 150 ppm per minute.

20. A process accoring to claim 19, in which said refining additive to be added has a grain size of from 0.1 to 2.5 mm.

21. A process according to claim 15, in which said refining additive is added in the form of core wire, the granules of said refining additive forming a core and being surrounded by an elongated tubular casing.

22. A process according to claim 21, in which said refining additive contains at least 80 percent of Ca and up to 15 percent of Ni or at least 80 percent of Ca and up to 15 percent of Al, in percent by weight.

23. A process according to claim 22, in which the speed of introduction of said core wire in the liquid steel is adjusted in such a manner that the quantity of calcium introduced is from 80 g to 120 g per tonne of liquid steel per minute.

24. A process according to claim 21, in which treatment is carried out in a pocket and/or in a distributor.

25. A process according to claim 15 for refining steels with a low content of carbon, silicon or residual elements, stainless or highly alloyed steel or cast iron.

26. A process according to claim 25 for refining a liquid steel, a which the content of Si before introduction of the alloy is at least than or equal to 300 ppm so as to obtain a steel which is suitable for deep drawing with a low final Si content.

27. A process for treating a metal or alloy which comprises adding thereto, when said metal or alloy is in a molten state, a refining additive comprising an alloy having no iron and manganese therein of a metal selected from the group consisting of alkaline earth metals and zinc, together with a quantity of a metallic element which is sufficient to give the alloy a melting point which is substantially lower than that of said alkaline earth metal or pure zinc, the refining additive being used in the form of granules.

28. A process according to claim 27, in which said metallic element is selected from the group consisting of aluminum, copper, nickel, bismuth, lead, tin, lanthanum and silicon, zinc alloyed with at least one other metal, and magnesium alloyed to with least one other metal.

29. A process according to claim 27, in which said refining additive to be added is a eutectic alloy.

30. A process according to claim 27, in which said refining additive to be added is an alloy situated in the first eutectic zone in drawing FIG. 1.

31. A process according to claim 27, in which said refining additive to be added is a calcium and nickel alloy containing up to 16 atomic % of nickel.

32. A process according to claim 27, in which said refining additive to be added is a magnesium and nickel alloy containing up to 11.3 atomic % of nickel.

33. A process according to claim 31, in which said refining additive is added at a rate of up to 150 ppm per minute.

34. A process according to claim 33, in which said refining additive to be added has a grain size of from 0.1 to 2.5 mm.

35. A process according to claim 27, in which said refining additive is added in the form of core wire, the granules of said refining additive forming a core and being surrounded by an elongated tubular casing.

36. A process according to claim 35, in which said refining additive contains at least 80 percent of Ca and up to 15 percent of Ni or at least 80 percent of Ca and up to 15 percent of Al, in % by weight.

37. A process according to claim 36, in which the speed of introduction of said core wire in the liquid steel is adjusted in such a manner that the quantity of calcium introduced is from 80 g to 120 g per tonne of liquid steel per minute.

38. A process according to claim 35, in which treatment is carried out in a pocket and/or in a distributor.

39. A process according to claim 27 for refining steels with a low content of carbon, silicon or residual elements, stainless or highly alloyed steel or cast iron.

40. A process according to claim 39 for refining a liquid steel of which the content of Si before introduction of the alloy is at most equal to 800 ppm so as to obtain a steel which is suitable for deep drawing with a low final Si content.

41. A core wire for adding a refining additive to a metal or an alloy when said metal or alloy is in a molten state, said core wire comprising an elongated tubular casing surrounding a core of said refining additive, said refining additive consisting essentially of an alloy of a metal selected from the group consisting of alkaline earth metals and zinc, together with a quantity of a metallic element which is sufficient to give the alloy a melting point which is substantially lower than that of said alkaline earth metal or pure zinc, the refining additive being in the form of granules.

42. A core wire as claimed in claim 41, wherein said refining additive to be added is an alloy situated in the first eutectic zone in drawing FIG. 1.

43. A core wire as claimed in claim 41, wherein said refining additive contains at least 80 percent of Ca and up to 15 percent of Ni in percent by weight.

44. A core wire as claimed in claim 41, wherein said refining additive contains at least 80 percent of Ca and up to 15 percent of Ni in percent by weight.

45. A core wire as claimed in claim 41, wherein said refining additive is a magnesium and nickel alloy containing up to 11.3 atomic percent of nickel.

46. A core wire as claimed in claim 41, wherein said granules have a diameter of from 0.1 to 2.5 mm.

* * * * *